US008910899B2

(12) United States Patent
Miyamoto et al.

(10) Patent No.: US 8,910,899 B2
(45) Date of Patent: Dec. 16, 2014

(54) CORE TUBE HOLDING DEVICE AND IMAGE RECORDING DEVICE

(71) Applicant: Seiko Epson Corporation, Tokyo (JP)

(72) Inventors: Satoru Miyamoto, Nagano (JP); Toru Tanjo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 151 days.

(21) Appl. No.: 13/686,187

(22) Filed: Nov. 27, 2012

(65) Prior Publication Data

US 2013/0206894 A1 Aug. 15, 2013

(30) Foreign Application Priority Data

Nov. 30, 2011 (JP) ..... 2011-261498

(51) Int. Cl.
*B65H 75/24* (2006.01)

(52) U.S. Cl.
CPC ..... *B65H 75/242* (2013.01)
USPC ..... 242/571; 242/571.8; 242/573; 242/573.1

(58) Field of Classification Search
CPC .... B65H 75/24; B65H 75/185; B65H 75/242; B65H 54/543
USPC ..... 242/571, 571.8, 572, 573, 573.1
See application file for complete search history.

(56) References Cited

U.S. PATENT DOCUMENTS 2,280,370 A * 4/1942 Bennett ..... 242/573.1
3,048,416 A * 8/1962 Rogers ..... 279/2.11
3,113,744 A * 12/1963 Nisenson ..... 242/572
3,143,308 A * 8/1964 Besnyo ..... 242/573.7
3,738,588 A * 6/1973 Ayers ..... 242/423.1
3,941,328 A * 3/1976 Johnson ..... 242/571.8
4,613,092 A * 9/1986 Nakai et al. ..... 242/573.9
6,206,323 B1 * 3/2001 Byars ..... 242/577
6,494,401 B2 * 12/2002 Bradshaw et al. ..... 242/573.7
8,490,912 B2 * 7/2013 Sanchez ..... 242/571.5

FOREIGN PATENT DOCUMENTS

JP 53-029795 Y 5/1975

* cited by examiner

*Primary Examiner* — Sang Kim
(74) *Attorney, Agent, or Firm* — Global IP Counselors, LLP

(57) ABSTRACT

A core tube holding device comprising: a plurality of out-pushing members that are arranged side by side spaced apart in the axial direction, each having a pressing part; a connecting member for connecting the plurality of out-pushing members; a holding member that has at every position in the axial direction a pressed part corresponding to the pressing part, and that is disposed radially outward with respect to the plurality of out-pushing members; and an action unit adapted to exert a force for moving, to one side in the axial direction, a one end out-pushing member which, among the plurality of out-pushing members, is at an end on the one side; wherein: at least one from among the pressing parts and the pressed parts is formed in a tapered shape that spreads radially outward from the one side to the other side in the axial direction, and when the force for moving the one end out-pushing member acts thereon via the action unit, the one end out-pushing member moves to the one side while also pulling the other out-pushing member(s) via the connecting member, and the pressing parts of each of the out-pushing members push the holding member radially outward via the corresponding pressed parts.

7 Claims, 7 Drawing Sheets

CORE TUBE HOLDING DEVICE AND IMAGE RECORDING DEVICE

CROSS-REFERENCE TO RELATED APPLICATIONS

This application claims priority to Japanese Patent Application No. 2011-261498 filed on Nov. 30, 2011. The entire disclosure of Japanese Patent Application No. 2011-261498 is hereby incorporated herein by reference.

BACKGROUND

1. Technical Field

The present invention relates to a core tube holding device adapted to hold a core tube in a detachable manner, as well as to an image recording device which uses the core tube holding device to support a core tube, with a sheet of a recording medium onto which an image is to be recorded being wound around the core tube.

2. Background Technology

One example of a device for adapted to hold a core tube is disclosed in Patent Document 1. The device is provided with a cylinder 1, a shaft 2 that is moved reciprocatingly in the axial direction by the action of the cylinder 1, and a key 4 that is provided to the outside of the shaft 2 in the radial direction. A plurality of tapered parts 2' that are arranged side by side in the axial direction are formed on the outside of the shaft 2 in the radial direction, and tapered surfaces are formed on the key 4 at positions that correspond in the axial direction to the tapered parts 2'. The configuration is such that the shaft 2 is pushed out in the axial direction by the cylinder 1, and when the tapered parts 2' (pressing parts) of the shaft 2 press on the tapered surfaces of the key 4 (pressed parts), the key 4 is thereby pushed out in the radial direction, and a paper tube 6 (a core tube) is thereby held.

Japanese Examined Utility Model Application Publication 53-29795 (Patent Document 1) is an example of the related art.

SUMMARY

Problems to be Solved by the Invention

In the device described in Patent Citation 1, a plurality of pressing parts were provided arranged side by side in the axial direction, and the shaft functions as a connecting member whereby the pressing parts are connected. In this configuration, then, the connecting member is pushed out in the axial direction whenever the core tube is being held. The connecting member accordingly is subjected to a compressive force, under which the connecting member can buckle, whenever each of the pressed portions corresponding thereto is pressed against.

It is an advantage of the invention, which was contrived in view of the foregoing problem, to provide a core tube holding device in which an inner peripheral surface of a core tube is pressed radially outward by a holding member to hold a core tube, as well as an image recording device provided with the core tube holding device, wherein buckling of a connecting member that connects a plurality of out-pushing members that push radially outward on the holding member is prevented.

Means Used to Solve the Above-Mentioned Problems

In order to achieve the foregoing advantage, the core tube holding device as in the invention is a core tube holding device for holding a cylindrical core tube extending in the axial direction, in a state where an inner peripheral surface of the core tube has been pressed out in a radially outward direction orthogonal to the axial direction, the core tube holding device including: a plurality of out-pushing members that are arranged side by side spaced apart in the axial direction, each of the out-pushing members having a pressing part that faces radially outward; a connecting member for connecting the plurality of out-pushing members; a holding member that has at every position in the axial direction corresponding to the pressing parts a pressed part facing the pressing part in the axial direction, and that is disposed radially outward with respect to the plurality of out-pushing members; and an action unit adapted to exert a force for moving, to one side in the axial direction, a one end out-pushing member which, among the plurality of out-pushing members, is at an end on the one side; wherein: at least one from among the pressing parts and the pressed parts is formed in a tapered shape that spreads radially outward from the one side to the other side in the axial direction, and when the force for moving the one end out-pushing member acts thereon via the action unit, the one end out-pushing member moves to the one side while also pulling the other out-pushing member(s) via the connecting member, and the pressing parts of each of the out-pushing members push the holding member radially outward via the corresponding pressed parts.

Also, in order to achieve the foregoing advantage, an image recording device as in the invention is an image recording device for recording an image onto a sheet of a recording medium, the image recording device including: a core tube holding unit for holding a cylindrical core tube extending in the axial direction, in a state where an inner peripheral surface of the core tube has been pressed out in a radially outward direction orthogonal to the axial direction; and a rotating mechanism for supplying the recording medium from the core tube or for taking up the recording medium around the core tube by causing the core tube holding means to rotate, the rotating mechanism being connected to the core tube holding means; wherein: the core tube holding means is provided with: a plurality of out-pushing members that are arranged side by side spaced apart in the axial direction, each of the out-pushing members having a pressing part that faces radially outward; a connecting member for connecting the plurality of out-pushing members; a holding member that has at every position in the axial direction corresponding to the pressing parts a pressed part facing the pressing part in the axial direction, and that is disposed radially outward with respect to the plurality of out-pushing members; and an action unit adapted to exert a force for moving, to one side in the axial direction, a one end out-pushing member which, among the plurality of out-pushing members, is at an end on the one side; wherein: at least one from among the pressing parts and the pressed parts is formed in a tapered shape that spreads radially outward from the one side to the other side in the axial direction, and when the force for moving the one end out-pushing member acts thereon via the action unit, the one end out-pushing member moves to the one side while also pulling the other out-pushing member(s) via the connecting member, and the pressing parts of each of the out-pushing members push the holding member radially outward via the corresponding pressed parts.

In the invention equipped with the configuration as per the foregoing (the core tube holding device and the image recording device), the plurality of out-pushing members having the out-pushing parts that face radially outward are arranged side by side in the axial direction, and are connected by the connecting member. Also, the pressed parts which face the pressing parts in the axial direction are provided, at every position in the axial direction corresponding to the pressing parts, to the holding member provided radially outward with respect to the pressing members. At least one from among the pressing parts and the pressed parts is formed in a tapered shape that spreads radially outward from the one side to the other side in the axial direction, and when each of the out-pushing members moves to the one side, the pressing parts of each of the out-pushing members push the holding member radially outward via the corresponding pressed parts. As such, it is possible for the inner peripheral surface of the core tube to be pressed by the holding member being pushed out in this manner, thus holding the core tube.

Furthermore, according to the invention, there is provided the action unit adapted for exerting the force for moving, to the one side in the axial direction, the one end out-pushing member which, among the plurality of out-pushing members, is at the end on the one side. Thus, when the force for moving the one end out-pushing member acts thereon via the action unit, the one end out-pushing member moves to the one side while also pulling the other out-pushing member(s) via the connecting member, and the holding member projects radially outward. In other words, each of the out-pushing members is moved to the one side, and the holding member is projected radially outward in order to hold the core tube, whereupon the connecting member will be pulled rather than being pushed. That is, when the core tube is to be held, a tensile force is applied to the connecting member, rather than a compressive force, and thus it is possible to prevent buckling of the connecting member.

In a preferred configuration, a through hole perforating through in the axial direction is formed on the one end out-pushing member, and the action unit is provided with: a grip part provided closer to the one side than the through hole; a shaft part which extends out from the grip part to the other side, and is inserted into the through hole; and a collar part provided to the shaft part closer to the other side than the through hole, the diameter of the collar part being greater than that of the through hole.

According to the configuration of such description, when the force adapted for moving the one end out-pushing member to the one side is applied to the action unit, a portion of the collar part having a greater diameter than the through hole will press the one end out-pushing member to the one side from the other side, and the one end out-pushing member is thereby moved to the one side while also pulling the other out-pushing member(s) via the connecting member. That is, in a case where the force adapted for moving the one end out-pushing member to the one side is applied to the action unit, a pressing force is reliably transmitted while also a state of engagement between the collar part and the one end out-pushing member is being maintained, and thus work performance for when the core tube is held is enhanced.

Also, preferably, the invention is further provided with a support member for slidably supporting the plurality of out-pushing members, the support member being inserted into holes opening in the axial direction formed on the plurality of out-pushing members; wherein, in the one end out-pushing member, a hole is formed so as to enclose the collar part while also communicating with the through hole from the other side; the shaft part is connected via a screw mechanism to an end part on one end of the support member; and when the action unit is rotated with respect to the support member, the one end out-pushing member is thereby moved to the one side.

A state of engagement between the pressing parts and the pressed parts takes place in a state where the plurality of out-pushing members have moved to the one side and each of the pressing parts is pushing the holding member radially outward via each of the corresponding pressed parts, thus holding the core tube. However, in the state where the core tube is being held, when the plurality of out-pushing members are unintentionally moved to the other side, the state of engagement between the pressing parts and the pressed parts is loosened, and it can no longer be possible for the core tube to be held. Herein, when the shaft part of the action unit is connected to the holding member by the screw mechanism, the action unit will not move in the axial direction provided that a rotational force is not transmitted to the shaft part. That is, even though the one end out-pushing member can attempt to move to the other side during the holding state, the movement thereof is hindered by the collar part of the action unit, and the one end out-pushing member and the other out-pushing member(s) connected thereto can be prevented from moving to the other side. Accordingly, the state of engagement between each of the pressing parts and each of the pressed parts can be prevented from being loosened, and the core tube can be stably held.

Also, preferably, there are at least three of the holding members provided at equal spacing in the peripheral direction. When the configuration of such description is adopted, a radially outward pressing force can be exerted in a uniform manner in the peripheral direction when the holding members press radially outward on and hold the inner peripheral surface of the core tube. It is accordingly possible to enhance the stability of the holding state without irregularly deforming the core tube.

Also, preferably, both the pressing parts and the pressed parts are formed in similar tapered shapes that spread radially outward from the one side toward the other side. When the pressing parts and the pressed parts are formed in similar tapered shapes, a radially outward pressing force can be stably transmitted to the pressed parts from the pressing parts, because the pressing parts and the pressed parts can be abutted against each other in an even wider area. Moreover, by having the pressing parts and the pressed parts abut against each other in a wide region, it is possible to avoid concentration of the load onto a part of the pressing parts or of the pressed parts, and it is also possible to suppress wear on the pressing parts or on the pressed parts.

Also, preferably, the invention is further provided with a spring for urging the holding member(s) radially inward. When the spring(s) of such description is/are provided, the holding member(s) is/are urged radially inward and is/are separated from the inner peripheral surface of the core tube when in a state where the holding member(s) is/are not holding the inner peripheral surface of the core tube. It is accordingly possible to suppress contact between the holding member(s) and the inner peripheral surface of the core tube whenever the core tube is to be attached or detached, and unencumbered attachment or detachment becomes possible.

BRIEF DESCRIPTION OF THE DRAWINGS

Referring now to the attached drawings which form a part of this original disclosure.

DETAILED DESCRIPTION OF EXEMPLARY EMBODIMENTS

Configuration of the Printer

Figure 1:
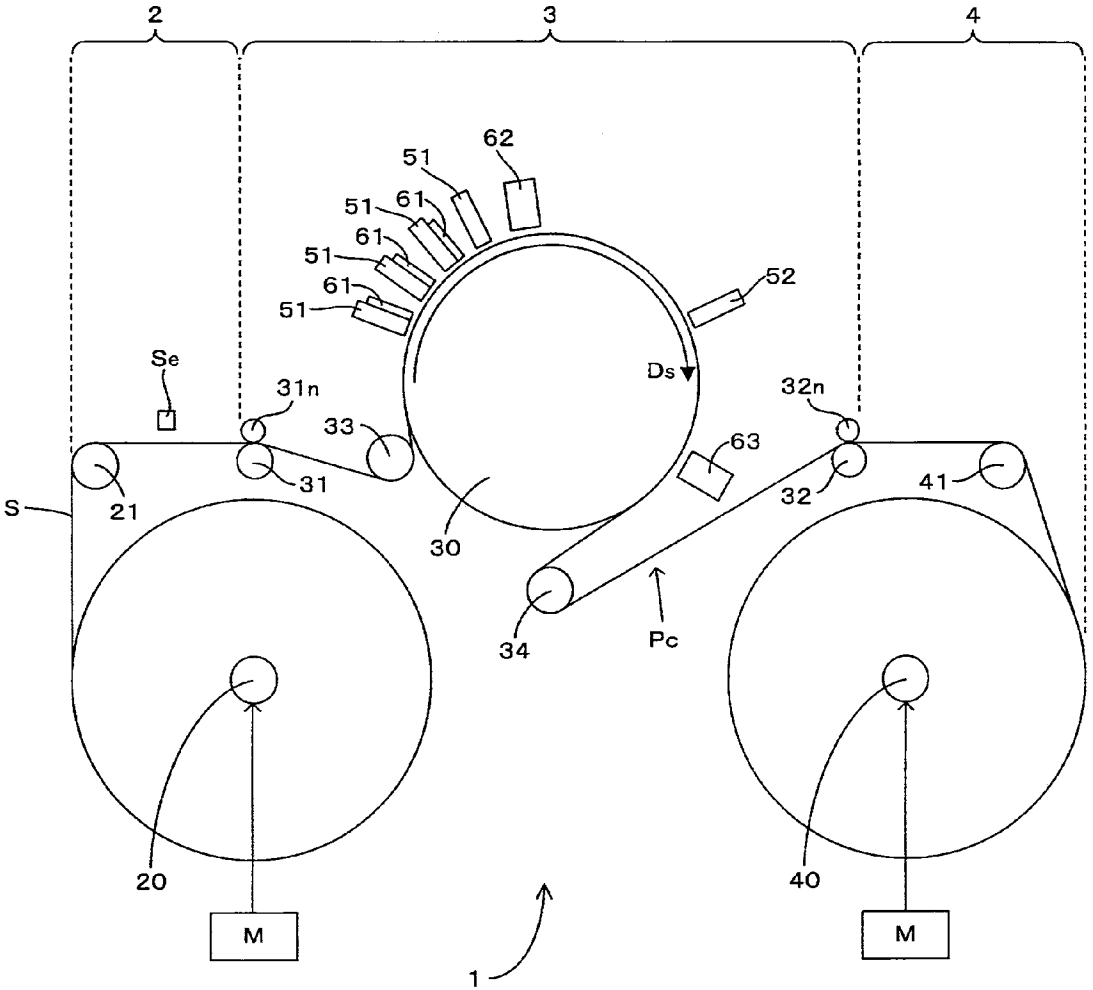
FIG. 1 is a drawing illustrating a configuration of a printer to which the core tube holding device as in the invention can be applied.

FIG. 1 is a plan view schematically illustrating an example of a configuration of a device configuration provided to a printer to which the invention can be applied. As illustrated in FIG. 1, in a printer 1, a single sheet S (web) having two ends that have been wound in a roll-shaped fashion around a supply spindle 20 and a take-up spindle 40 is stretched between the supply spindle 20 and the take-up spindle 40, and the sheet S is conveyed from the supply spindle 20 to the take-up spindle 40 along a path Pc having been thus stretched. In the printer 1, an image is recorded onto the sheet S being conveyed along the conveyance pathway Pc. The type of sheet S is largely divided into paper-based and film-based. As specific examples, paper-based includes high-quality paper, cast paper, art paper, coated paper, and the like, while film-based includes synthetic paper, PET (Polyethylene terephthalate), PP (polypropylene), and the like. In brief, the printer 1 is provided with: a supply unit 2 for supplying the sheet S from the supply spindle 20; a process unit 3 for recording an image onto the sheet S having been supplied from the supply unit 2; and a take-up unit 4 for taking up, around the take-up spindle 40, the sheet S on which the image has been recorded by the process unit 3. In the following description, whichever side of the two sides of the sheet S is the one on which the image is recorded is referred to as the "front surface", while the side opposite thereto is referred to as the "back surface".

The supply unit 2 has the supply spindle 20, around which an end of the sheet S has been wound, as well as a driven roller 21 around which is wound the sheet S having been drawn out from the supply spindle 20. The supply unit 20 supports the end of the sheet S wound therearound in a state where the front surface of the sheet S faces outward. When the supply spindle 20 is rotated in the clockwise direction in FIG. 1, the sheet S having been wound around the supply spindle 20 is thereby made to pass via the driven roller 21 and supplied to the process unit 3. It should also be noted that the sheet S is wound about the supply spindle 20 with a core tube (not shown) therebetween, the core tube being detachable with respect to the supply spindle 20. As such, when the sheet S of the supply spindle 20 has been exhausted, it is possible for a new core tube around which a roll of the sheet S has been wound to be mounted onto the supply spindle 20, to replace the sheet S of the supply spindle 20. The supply spindle 20 rotates under a driving force from a motor M that is connected to a base shaft thereof (to be described in greater detail below).

The process unit 3 is intended to record an image onto the sheet S by carrying out a process, as appropriate, using functional units 51, 52, 61, 62, 63 arranged along the outer peripheral surface of a platen drum 30 while the platen drum 30 supports the sheet S having been supplied from the supply unit 2. In the process unit 3, a front drive roller 31 and a rear drive roller 32 are provided on two ends of the platen drum 30, and the sheet S, which is conveyed from the front drive roller 31 to the rear drive roller 32, is supported on the platen drum 30 and undergoes image recording.

The front drive roller 31 has on the outer peripheral surface a plurality of minute projections formed by thermal spraying, and the sheet S having been supplied from the supply unit 2 is wound around from the back surface side. When the front drive roller 31 is rotated in the clockwise direction in FIG. 1, the sheet S having been supplied from the supply unit 2 is thereby conveyed downstream on the conveyance path. A nip roller 31*n* is provided to the front drive roller 31. The nip roller 31*n* is urged toward the front drive roller 31 side and in this state abuts against the front surface of the sheet S, and sandwiches the sheet S with the front drive roller 31 on the other side. This ensures the force of friction between the front drive roller 31 and the sheet S, and makes it possible for the front drive roller 31 to reliably convey the sheet S.

The platen drum 30 is a cylindrically-shaped drum rotatably supported by a support mechanism (not shown), and the sheet S being conveyed from the front drive roller 31 to the rear drive roller 32 is wound therearound from the back surface side. The platen drum 30 is intended to support the sheet S from the back surface side while also reciprocatingly rotating in a conveyance direction Ds of the sheet S, under the force of friction against the sheet S. It should also be noted that in the process unit 3, driven rollers 33, 34 for folding the sheet S on both sides of a section wound around the platen drum 30 are provided. Of these, the driven roller 33 folds the sheet S with the front surface of the sheet S wound between the front drive roller 31 and the platen drum 30. On the other hand, the driven roller 34 folds the sheet S with the front surface of the sheet S wound between the platen drum 30 and the rear drive roller 32. In this manner, the sheet S is folded upstream and downstream of the platen drum 30 in the conveyance direction Ds, whereby the length of the wound section of the sheet S on the platen drum 30 can be ensured.

The rear drive roller 32 has on the outer peripheral surface a plurality of minute projections formed by thermal spraying, and the sheet S having been conveyed from the platen drum 3 via the driven roller 34 is wound therearound from the back surface side. When the rear drive roller 32 is rotated in the clockwise direction in FIG. 1, the sheet S is thereby conveyed toward the take-up unit 4. A nip roller 32*n* is provided to the rear drive roller 32. This nip roller 32 is urged toward the rear drive roller 32 and in this state abuts against the front surface of the sheet S, and sandwiches the sheet S with the rear drive roller 32 on the other side. This ensures the force of friction between the rear drive roller 32 and the sheet S, and makes it possible for the rear drive roller 32 to reliably convey the sheet S.

In this manner, the sheet S being conveyed from the front drive roller 31 to the rear drive roller 32 is supported on the outer peripheral surface of the platen drum 30. Also, with the process unit 3, in order to record a color image onto the front surface of the sheet S being supported on the platen drum 30, a plurality of recording heads 51 corresponding to mutually different colors are provided. Specifically, four recording heads 51 corresponding to yellow, cyan, magenta, and black are lined up in the stated order of colors in the conveyance direction Ds. Each of the recording heads 51 faces the front surface of the sheet S wound around the platen drum 30, with a certain amount of clearance therebetween, and ejects ink of the corresponding color in an ink jet scheme. When each of the recording heads 51 ejects ink onto the sheet S being conveyed toward the conveyance direction Ds, a color image is thereby formed on the front surface of the sheet S.

It should be noted that the ink used is a UV (ultraviolet) ink that is cured by being irradiated with ultraviolet rays (light)

(i.e., is a photo-curable ink). In view whereof, with the process unit 3, in order to cure the ink and affix same to the sheet S, UV lamps 61, 62 (light irradiation units) are provided. The execution of this curing of the ink is divided into two stages, which are temporary curing and true curing. A UV lamp 61 for temporary curing is arranged between each of the plurality of recording heads 51. Namely, the UV lamp 61 is intended to irradiate with weak ultraviolet rays and thereby cure the ink to such an extent that the shape of the ink is not lost (temporary curing), and is not intended to fully cure the ink. On the other hand, a UV lamp 62 for true curing is provided downstream in the conveyance direction Ds with respect to each of the plurality of recording heads 51. Namely, the UV lamp 62 irradiates with stronger ultraviolet rays than the UV lamp 61 and is intended to thereby fully cure the ink (true curing). Executing the temporary curing and true curing in this manner makes it possible to affix onto the front surface of the sheet S the color image formed by the plurality of recording heads 51.

Also, a recording head 52 is provided downstream in the conveyance direction Ds with respect to the UV lamp 62. This recording head 52 faces the front surface of the sheet S wound around the platen drum 30, with a certain amount of clearance therebetween, and ejects a transparent UV ink onto the front surface of the sheet S in an ink jet scheme. In other words, the transparent ink is additionally ejected onto the color image formed by the recording heads 51 of the four different colors. A UV lamp 63 is also provided downstream in the conveyance direction Ds with respect to the recording head 52. This UV lamp 63 irradiates with strong ultraviolet rays and is intended to thereby fully cure (true curing) the transparent ink having been ejected by the recording head 52. This makes it possible to affix the transparent ink onto the front surface of the sheet S.

With the process unit 3, this manner of ejecting and curing ink is executed as appropriate on the sheet S wound about the outer peripheral part of the platen drum 30, and a color image coated with the transparent ink is formed. Also, the sheet S on which the color image has been formed is conveyed toward the take-up unit 4 by the rear drive roller 32.

In addition to the take-up spindle 40 around which an end of the sheet S is wound, the take-up unit 4 also has a driven roller 41 around which the sheet S is wound from the back surface side between the take-up spindle 40 and the rear drive roller 32. The take-up spindle 40 supports one end of the sheet S taken up therearound in a state where the front surface of the sheet S is facing outward. Namely, when the take-up spindle 40 is rotated in the clockwise direction in FIG. 1, the sheet S, which has been conveyed from the rear drive roller 32, passes through the driven roller 41 and is taken up around the take-up spindle 40. It also should be noted that the sheet S is taken up around the take-up spindle 40 with a core tube (not shown) therebetween, the core tube being detachable with respect to the take-up spindle 40. As such, when the sheet S taken up around the take-up spindle 40 is fully stocked, it becomes possible to remove the sheet S in an amount commensurate with the core tube. The take-up spindle 40 rotates under a driving force from a motor M that is connected to a base shaft thereof (to be described in greater detail below).

Configuration of the Core Tube Holding Device

In the printer 1 serving as the "image recording device", which has been configured as described above, the supply spindle 20 or the take-up spindle 40 functions as the "core tube holding device (a core tube holding means)" for holding the core tube in a detachable manner. Provided below is a more detailed description of the core tube holding device, on the basis of the accompanying drawings.

Figure 2:
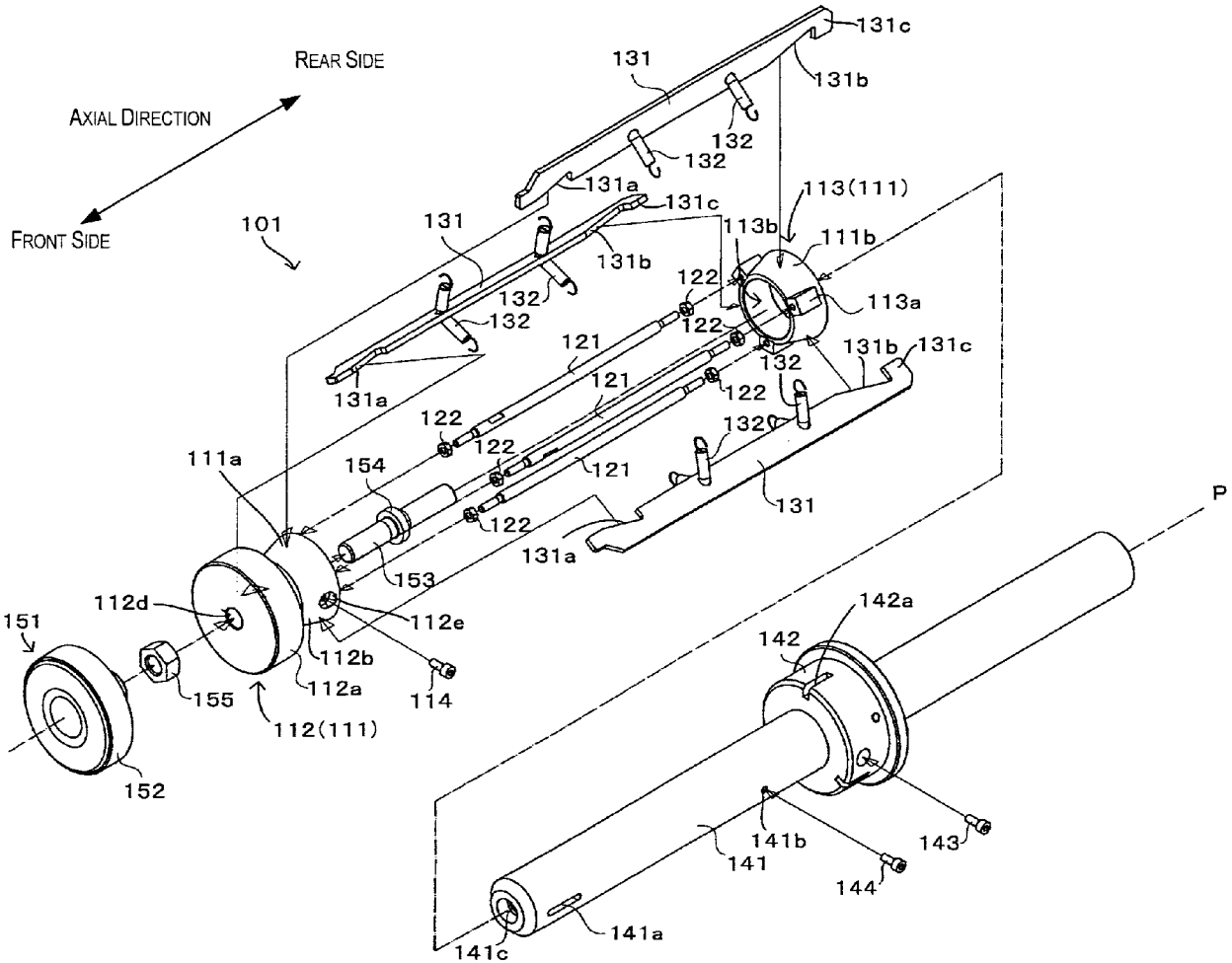
FIG. 2 is an exploded perspective view of a core tube holding device.
Figure 3:
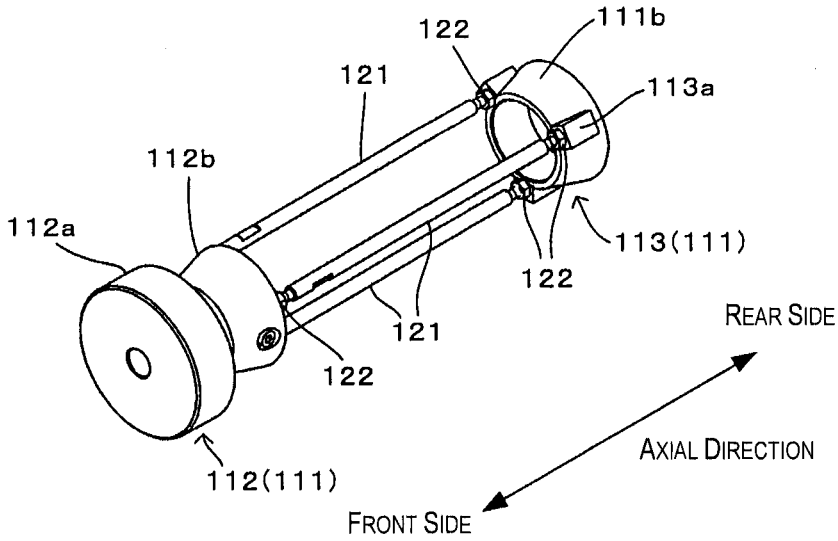
FIG. 3 is a perspective view of an assembly in a state where sleeves and connecting members have been assembled.
Figure 4:
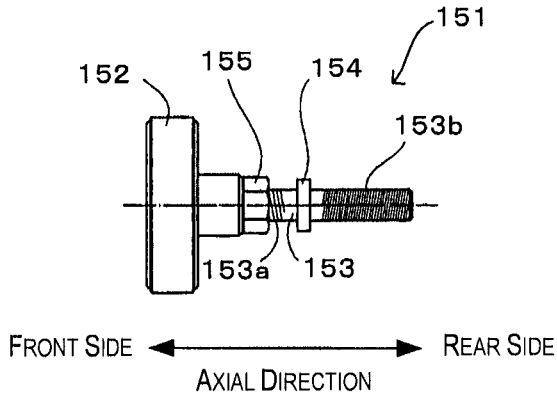
FIG. 4 is a perspective view of an assembly of an action tool.
Figure 5:
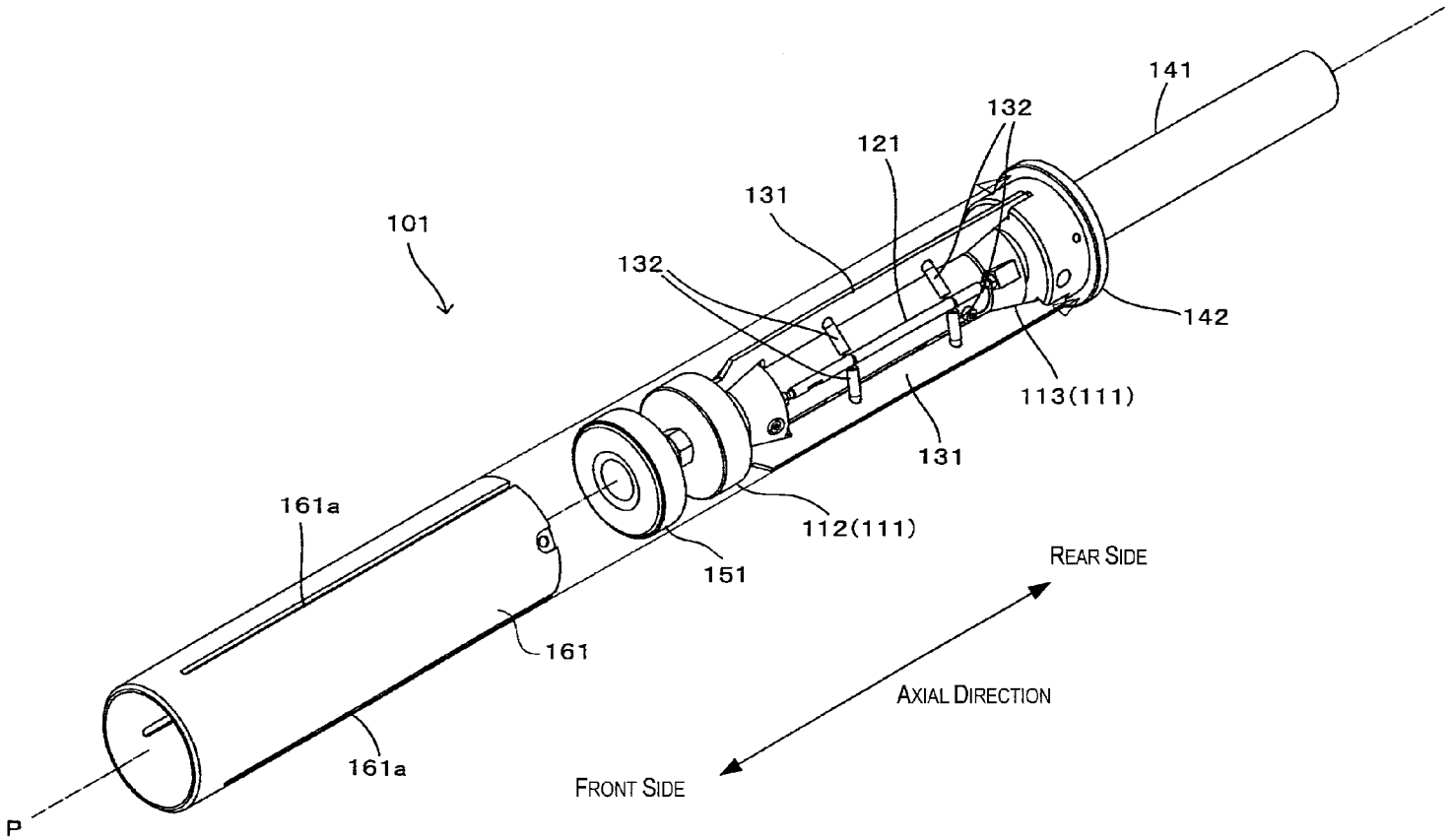
FIG. 5 is a perspective view of an assembly of a core tube holding device before a housing has been fitted thereon.
Figure 6:
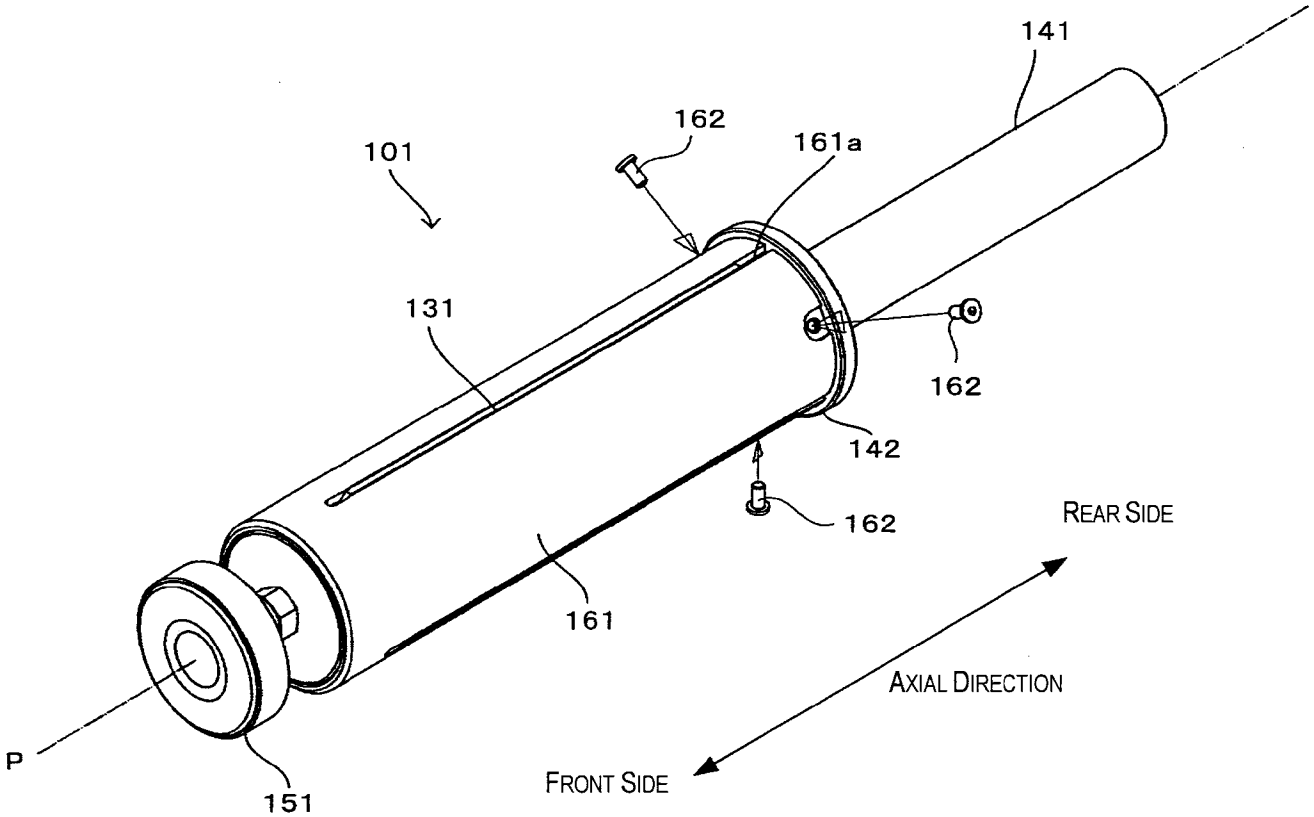
FIG. 6 is a perspective view of an assembly of a core tube holding device after a housing has been fitted thereon.
Figure 7A:
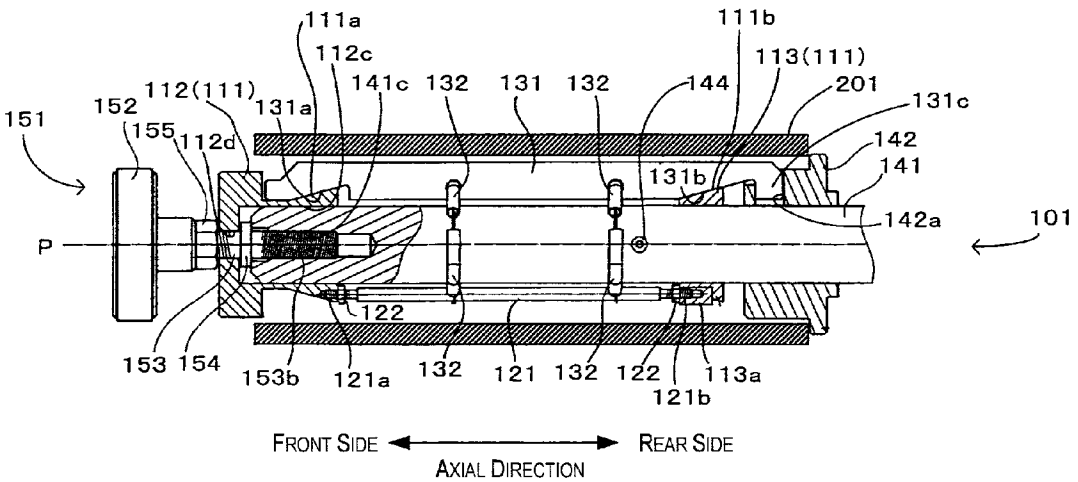
FIGS. 7A and 7B are longitudinal cross-sectional views illustrating the operation of a core tube holding device.
Figure 7B:
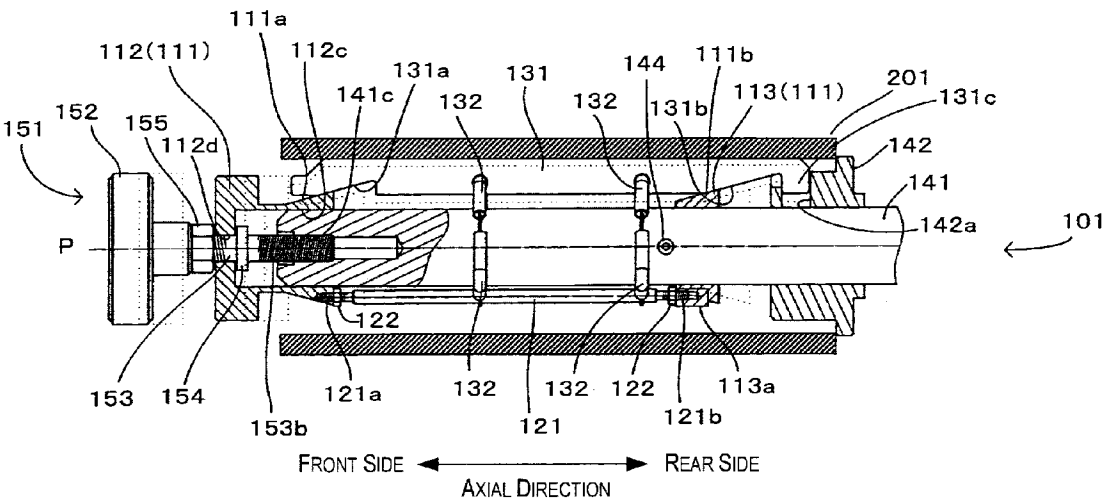

FIG. 2 is an exploded perspective view of a core tube holding device as in the present embodiment; FIG. 3 is a perspective view of an assembly in a state where sleeves and connecting members of the core tube holding device have been assembled; FIG. 4 is a perspective view of an assembly of an action tool of the core tube holding device; FIG. 5 is a perspective view of an assembly of the core tube holding device before a housing has been fitted thereon; FIG. 6 is a perspective view of an assembly of the core tube holding device after the housing has been fitted thereon; and FIGS. 7A and 7B are longitudinal cross-sectional views illustrating the core tube holding device.

A core tube holding device 101 is equipped with a general configuration in which each of the constituent parts is supported by a base shaft 141 serving as a "support member", and rotates under the drive force of the motor M (see FIG. 1), which serves as a "rotating mechanism", connected to the base shaft 141. As is illustrated in FIGS. 7A and 7B, the core tube holding device 101 holds a core tube 201 so that a shaft core of the core tube 201 which has been fitted onto the core tube holding device 101 will be matched to a shaft core P of the base shaft 141. Hereinbelow, the direction running along the shaft core P is referred to as the axial direction, and the direction orthogonal to the shaft core P is referred to as the radial direction. A side connected to a motor M in the axial direction (which is the right side in FIG. 2) is referred to as the rear side serving as the "other side", and the side opposite to the side connected to the motor M in the axial direction (which is the left side in FIG. 2) is referred to as the front side serving as the "one side".

The description shall now relate to a general summary of the overall configuration of the core tube holding device 101. The core tube holding device 101 is provided with: sleeves 111 serving as the "out-pushing members", arranged side by side and spaced apart in the axial direction; connecting members 121 for connecting the sleeves 111; and lugs 131 serving as the "holding members", disposed radially outward with respect to the sleeves 111. Tapered-shaped pressing parts 111*a*, 111*b* oriented to face radially outward are formed on the sleeves 111. Tapered-shaped pressed parts 131*a*, 131*b* which face the pressing parts 111*a*, 111*b* in the axial direction are formed on the lugs 131 at every position in the axial direction that corresponds to each of the pressing parts 111*a*, 111*b*. When the sleeves 111 are moved toward the front side, this causes the pressing parts 111*a*, 111*b* to respectively push the lugs 131 radially outward via the pressed parts 131*a*, 131*b* corresponding respectively thereto, whereby the inner peripheral surface of the core tube 201 is held (see FIGS. 7A and 7B).

The description shall now relate to the sleeves 111. In the present embodiment, there are two of the sleeves 111, disposed so as to be spaced apart in the axial direction. Hereinbelow, in a case where a distinction is to be made between the two sleeves 111, the one located on the front side is referred to as a front sleeve 112, serving as the "one end out-pushing member", and the one located on the rear side is referred to as a rear sleeve 113, serving as the "other out-pushing member"; in a case where a general term is to be used, the sleeves are simply referred to as the sleeves 111.

Both the front sleeve 112 and the rear sleeve 113 are configured to have an axisymmetric shape where the central axis is the shaft core P. The front sleeve 112 is configured by combining together a front-side bottomed cylindrical part 112*a* and a rear-side conical part 112*b*. A conical surface of the conical part 112*b* spreads radially outward from the front side toward the rear side, and functions as the pressing part 111*a*. A hole 112*c* opening toward the rear side (see FIGS. 7A and 7B) is formed on the interior of the front sleeve 112. The hole 112*c* is formed in a cylindrical shape, where the center is the shaft core P of the base shaft 141. The base shaft 141 is inserted into the hole 112*c* from the rear side, and slidably supports the front sleeve 112 in the axial direction. A through hole 112*d* where the center is the shaft core P perforates through at a front-side bottom part of the bottomed cylindrical part 112*a*. The through hole 112*d* is in communication with the rear-side hole 112*c*. However, the diameter of the through hole 112*d* is smaller than the diameter of the hole 112*c*, and the configuration is such that the base shaft 141 cannot be inserted into the through hole 112*d*.

Similarly with respect to the conical part 112*b* of the front sleeve 112, the rear sleeve 113 is formed in a conical shape that spreads radially outward from the front side toward the rear. However, unlike the front sleeve 112, a block part 113*a* that projects radially outward is provided on the conical surface of the rear sleeve 113 at every 120° in the peripheral direction. The portion of the outer peripheral surface of the rear sleeve 113 where the block part 113*a* is not formed functions as the pressing part 111*b*. A cylindrical hole 113*b* where the center is the shaft core P is formed so as to perforate through in the axial direction on the rear sleeve 113. The base shaft 141 is inserted into the hole 113*b* from the rear side, and slidably supports the rear sleeve 113 in the axial direction.

The description shall now relate to the connecting members 121. FIG. 3 illustrates a state where the front sleeve 112 and the rear sleeve 113 have been connected by the connecting members 121. In the present embodiment, the connecting members 121, which are rod-shaped and extend in the axial direction, are provided at every 120° in the peripheral direction, and each of the connecting members 121 is disposed so as to be parallel to the shaft core P. When the plurality of connecting members 121 are provided at equal intervals in the peripheral direction in this manner, a force that is transmitted from the front sleeve 112 to the rear sleeve 113 via the connecting members 121 or is transmitted from the rear sleeve 113 to the front sleeve 112 via the connecting members 121 whenever the front sleeve 112 and the rear sleeve 113 are moved in the axial direction will be uniform in the peripheral direction. It is accordingly possible to suppress unintended tilting of either the front sleeve 112 or the rear sleeve 113 that would be caused because of non-uniform transmission of the force via the connecting members 121 in the peripheral direction whenever the front sleeve 112 and the rear sleeve 113 are moved in the axial direction.

As is illustrated in FIGS. 7A and 7B, a male screw part 121*a* of the right-hand screw type is formed at a front-side end part of the connecting members 121, and a male screw part 121*b* of the left-hand screw type is formed on a rear-side end part of the connecting members 121. In order for the connecting members 121 to be screwed in, a female screw of the right-handed screw type is formed at a rear-side end surface of the front sleeve 112 at every 120° in the peripheral direction, and a female screw of the left-handed screw type is formed on each of the block parts 113*a* of the rear sleeve 113. The front side can also be the left-handed screw type, the rear side then being the right-handed screw type.

Screws of different types are thus formed at the two end parts of the connecting members 121, and the forward and backward directions of the screws with respect to the direction of rotation are inverted at the two end parts of the connecting members 121. For this reason, by changing the direction of rotation of the connecting members 121, it is possible to lengthen or shorten the spacing between the front sleeve 112 and the rear sleeve 113 in the axial direction. In a more specific description, the spacing between the front sleeve 112 and the rear sleeve 113 in the axial direction becomes shorter when the connecting members 121 are rotated in a screwing-in direction whereby the connecting members 121 have been screwed into the front sleeve 112 and the rear sleeve 113. However, the spacing between the front sleeve 112 and the rear sleeve 113 in the axial direction becomes longer when the connecting members 121 are rotated in a pull-out direction (the direction inverse to the screwing-in direction) whereby the connecting members 121 are pulled out from both the front sleeve 112 and the rear sleeve 113. It is therefore possible to easily change the spacing between the front sleeve 112 and the rear sleeve 113 by changing the level to which the connecting members 121 are screwed into the front sleeve 112 and the rear sleeve 113. Nuts 122 are also provided to the male screw parts 121*a*, 121*b* of the connecting members 121; fastening the nuts 122 thereon makes it possible to prevent loosening of the connections between the connecting members 121 and the sleeves 111.

The description shall now relate to the configuration of the lugs 131. In the present embodiment, the lugs 131 are provided at every 120° in the peripheral direction, radially outward with respect to the sleeves 111. When three or more of the lugs 131 are provided in this manner at equal spacing in the peripheral direction, a radially outward pressing force can be exerted in a uniform manner in the peripheral direction when the lugs 131 push radially outward on and hold the inner peripheral surface of the core tube 201. It is accordingly possible to enhance the stability of the holding state without irregularly deforming the core tube 201.

The positional relationship between the connecting members 121 and the lugs 131 in the peripheral direction is one with an offset of 60°. That is, the connecting members 121 and the lugs 131 are disposed alternately every 60° in the peripheral direction. The lugs 131 are elongated members that extend along the axial direction, and the pressed parts 131*a*, 131*b* are formed at every position that corresponds in the axial direction to the pressing parts 111*a*, 111*b* that are formed on the sleeves 111.

The pressed parts 131*a* face the corresponding pressing part 111*a* in the axial direction, and are formed in a tapered shape having the same angle of tilt as the pressing part 111*a*. When the pressing part 111*a* and the pressed parts 131*a* are formed in this manner in similar tapered shapes, a radially outward pressing force can be stably transmitted to the pressed parts 131*a* from the pressing part 111*a*, because the pressing part 111*a* and the pressed parts 131*a* can be abutted against each other in a wider area. By having the pressing part 111*a* and the pressed parts 131*a* abut against each other in a wide region, it is possible to avoid concentration of the load onto a part of the pressing part 111*a* or of the pressed parts 131*a*, and it is also possible to suppress wear on the pressing part 111*a* or on the pressed parts 131*a*. Similarly, the pressed parts 131*b* face the corresponding pressing part 111*b* in the axial direction, and are formed in a tapered shape having the same angle of tilt as the pressing part 111*b*.

The lugs 131 are provided radially outward also with respect to the connecting members 121. The connecting members 121 and the lugs 131, which are adjacent in the peripheral direction, are connected by springs 132, which are tension springs, and the lugs 131 are urged radially inward at all times by the restoring force of the springs 132. Herein, the springs 132 are provided at two locations in the axial direction. When the springs 132 of such description are provided, the lugs 131 are urged radially inward and are separated from the inner peripheral surface of the core tube 201 when in a state where the lugs 131 are not holding the inner peripheral surface of the core tube 201. It is accordingly possible to suppress contact between the lugs 131 and the inner peripheral surface of the core tube 201 whenever the core tube 201 is to be attached or detached, and unencumbered attachment or detachment becomes possible.

Projecting parts 131*c* that project radially inward are also formed at the rear-side end parts of the lugs 131; the configuration is such that when the projecting parts 131*c* engage with locking holes 142*a* of a flange 142 provided to the base shaft 141 (to be described below), the lugs 131 are thereby prevented from moving in the axial direction (see FIGS. 7A and 7B).

The description shall now relate to the base shaft 141. The base shaft 141 is a member that extends in the axial direction, and the flange 142, which is cylindrical, is fixed by a bolt 143 to a middle section thereof. The locking holes 142*a*, adapted for receiving the projecting parts 131*c* of the lugs 131, are formed at every 120° in the peripheral direction on the outer peripheral surface of the flange 142. A portion of the base shaft 141 closer to the rear side than the flange 142 is connected to a motor M (see FIG. 1). Meanwhile, a portion of the base shaft 141 that is closer to the front side than the flange 142 is inserted into the hole 112*c* of the front sleeve 112 and the hole 113*b* of the rear sleeve 113, and slidably supports the front sleeve 112 and the rear sleeve 113.

A female screw part 141*c* of the left-handed screw type, which opens to the front side, is formed on the front-side end surface of the base shaft 141, and a male screw part 153*b* of a shaft part 153 of an action tool 151 (to be described below) is screwed thereinto. A groove 141*a* that extends along the axial direction is formed on the outer peripheral surface of the base shaft 141 in the vicinity of the front-side end part thereof. By screwing a bolt 114 into a bolt hole 112*e* formed on the conical part 112*b* of the front sleeve 112 and positioning a distal end part of the bolt 114 in the interior of the groove 141*a* in a state where the base shaft 141 has been inserted into the front sleeve 112 and the rear sleeve 113, it is possible for the front sleeve 112 to move in the axial direction with respect to the base shaft 141, but relative rotation will not be possible. A bolt hole 141*b* is also formed closer to the front side on the base shaft 141 than the flange 142. By fixing a bolt 144 to the bolt hole 141*b* in the state where the base shaft 141 has been inserted into the front sleeve 112 and the rear sleeve 113, a distal end part of the bolt 144 hinders the rear sleeve 113 from coming lose toward the front.

The description shall next relate to the action tool 151, serving as the "action unit". The action tool is a site adapted for exerting a force for causing the front sleeve 112 to move forward. As is illustrated in FIG. 4, the action tool 151 is configured to be provided with: a grip part 152 provided to the front side; a shaft part 153 extending outward to the rear side from the grip part 152; and a collar part 154 provided to the shaft part 153.

A male screw part 153*a* of the right-handed screw type is formed on the outer peripheral surface of the shaft part 153, closer to the front side than the collar part 154, and the male screw part is screwed into a female screw part (not shown) formed on the grip part 152 to connect together the shaft part 153 and the grip part 152. A male screw part 153*b* of the left-handed screw type is formed on the outer peripheral surface of the shaft part 153, closer to the rear side than the collar part 154, and the male screw part is screwed into the female screw part 141*c* formed on the front-side end surface of the base shaft 141, to connect together the shaft part 153 and the base shaft 141. By making the screw types be different in this manner at the two end parts of the shaft part 153, it is possible to prevent the male screw part 153*a* of the shaft part 153 from being mistakenly connected to the base shaft 141, and to prevent the male screw part 153*b* from being mistakenly connected to the grip part 152.

A nut 155 is also provided to the male screw part 153*a* of the shaft part 153. By fastening the nut 155 onto the side of the grip part 152, it is possible to prevent loosening of the connection between the grip part 152 and the shaft part 153. FIG. 4 is a drawing that illustrates the assembled state of only the action tool 151, for the sake of making the description easier to understand, but in actuality the shaft part 153 is inserted into the through hole 112*d* formed in the bottomed cylindrical part 112*a* of the front sleeve 112 and the bottom part of the bottomed cylindrical part 112*a* is sandwiched between the collar part 154 and the nut 155, in which state the action tool 115 is assembled (see FIGS. 7A and 7B). The diameter of the collar part 154 is greater than the diameter of the through hole 112*d*, so as to prevent the collar part 154 from falling out from the through hole 112*d* of the front sleeve 112, and is smaller than the diameter of the hole 112*c*, so that the collar part 154 will be enclosed in the hole 112*c* of the front sleeve 112.

FIG. 5 illustrates a perspective view of a state where the sleeves 111, the connecting members 121, the lugs 131, the base shaft 141, and the action tool 151, as have been described thus far, have been assembled. A cylindrical housing 161 for covering the entirety thereof is attached to the elements that are in the state assembled as in FIG. 5. Slits 161*a* that extend in the axial direction are formed at every 120° in the peripheral direction on the housing 161, and the lugs 131 are received into the slits 161*a* in a state where the lugs can be retracted in the radial direction. As is illustrated in FIG. 6, the housing 161 is fixed to the flange 142 by the bolts 162.

Operation of the Core Tube Holding Device

The description shall now relate to the operation of the core tube holding device 101 configured in the foregoing manner, on the basis of FIGS. 7A and 7B. FIGS. 7A and 7B are longitudinal cross-sectional views of the core tube holding device 101, where FIG. 7A illustrates a non-holding state where the core tube 201 is not being held, and FIG. 7B illustrates a holding state where the core tube 201 is being held. In order for the drawings to be easier to view, a depiction of the housing 161 has been omitted.

In order for the core tube holding device 101 to be moved from the non-holding state (FIG. 7A) to the holding state (FIG. 7B), the grip part 152 of the action tool 151 is rotated to the right. In so doing, the action tool 151 moves to the front with respect to the base shaft 141, via the screw mechanism made of the male screw part 153*b* of the shaft part 153 and the female screw part 141*c* of the base shaft 141, and the collar part 154 presses forward on the bottom part of the bottomed cylindrical part 112 of the front sleeve 112, thus moving forward the front sleeve 112. The rear sleeve 113 is then pulled forward via the connecting members 121 in association with the forward movement of the front sleeve 112.

Moving the front sleeve 112 and the rear sleeve 113 forward in this manner causes the pressing part 111*a* of the front sleeve 112 to press radially outward on the pressed parts 131*a* of the lugs 131, causes the pressing part 111*b* of the rear sleeve 113 to press radially outward on the pressed parts 131*b* of the lugs 131, and thus causes the lugs 131 to be pushed radially outward. As a result thereof, the inner peripheral surface of the core tube 201 having been fitted onto the core tube holding device 101 is pressed radially outward by the lugs 131, and the core tube 201 is held by the core tube holding device 101.

When the sleeves 111 are moved forward and the core tube 201 is held, the lugs 131 will press on the inner peripheral surface of the core tube 201 while the pressing parts 111*a*, 111*b* of the sleeves 111 are also pressing on the pressed parts

131*a*, 131*b*, respectively, of the lugs 131. In order for the lug 131 to be able to hold the core tube 201 with an adequate pressing force, the force whereby the sleeves 111 are moved forward must also be adequately large. When the large force of such description acts as a compressive force on the connecting members 121 by which the sleeves 111 are connected, it is possible that the connecting members 121 can buckle.

However, according to the core tube holding device 101 of the present embodiment, the force whereby the front sleeve 112 is moved forward acts on the front sleeve 112 via the action tool 151, and the front sleeve 112 will move forward while the rear sleeve 113 is being pulled via the connecting members 121. It is accordingly possible to prevent the connecting members 121 from buckling, because it is a tensile force that acts on the connecting members 121 at this time, and not a compressive force.

Also, because there is no need for the connecting members 121 to be increased in size and increased in rigidity in order to prevent the buckling of the connecting members 121, it is possible to successfully reduce the weight of the connecting members 121. Accordingly, in a case where the core tube holding device 101 is being rotated by the motor M, the dynamic force needed for rotation and drive can be reduced, and it becomes possible to avoid a size increase or cost increase for the motor M.

When the holding state is to be released to bring about the non-holding state, it is necessary to move the sleeves 111 toward the rear. When the action tool 151 is rotated to the left to thereby make use of the force pushing the front sleeve 112 to the rear side, the rear sleeve 113 is also pushed to the rear side, via the connecting members 121, and a compressive force can act on the connecting members 121. However, when the non-holding state is to be brought about from the holding state, it is necessary only to release the state of engagement imparted by the force of friction between the pressing part 111*a* and the pressed parts 131*a* and between the pressing part 111*b* and the pressed parts 131*b*, and thus a force as great as when the holding state is implemented will not act on the connecting members 121, so it is very unlikely that buckling would be a problem.

Further, when the action tool 151 is connected to the base shaft 141 via the screw mechanism as per the present embodiment, the action tool 151 will not move in the axial direction provided that a rotational force is not transmitted to the action tool 151. That is, even though the front sleeve 112 can attempt to move to the rear side when in the holding state, the movement thereof is hindered by the collar part 154 of the action tool 151, and both the front sleeve 112 and the rear sleeve 113 connected thereto can thus be prevented from moving toward the rear side. It is accordingly possible to prevent loosening of the state of engagement between the pressing part 111*a* and the pressed parts 131*a* and the state of engagement between the pressing part 111*b* and the pressed parts 131*b*, and it becomes possible for the core tube 201 to be stably held.

Other Embodiments

The invention is not to be limited to the embodiment described above; rather, a variety of modifications can also be added to what was described above, provided that there is no departure from the spirit thereof, and modifications can be made as appropriate and as needed to the number, shape, dimensions, or arrangement relationship of each of the constituent components of the core tube holding device 101. Provided below are some examples thereof.

(1) In the embodiment described above, there were two of the sleeves 111 provided in the axial direction, and one pressing part was formed for each of the sleeves 111, but it would also be possible for there to be three or more of the sleeves 111 provided in the axial direction. It would also be possible for a plurality of pressing parts arranged side by side spaced apart in the axial direction to be formed for a single sleeve 111. It would additionally be possible for the plurality of sleeves 111 and the connecting members 121 for connecting same to be configured in an integrated manner.

(2) In the embodiment described above, the connecting members 121 and the lugs 131 were arranged alternately at every 60° in the peripheral direction. However, the number of connecting members 121 and lugs 131 provided in the peripheral direction need not be limited to three, and there is no need for the connecting members 121 and the lugs 131 to be necessarily arranged at equal spacing in the peripheral direction.

(3) In the embodiment described above, the action tool that is screwed into the base shaft 141 is provided as the "action unit". However the form of the action unit is not limited thereto. For example, the action tool 151 can be attached to the base shaft 141 in a state other than a screwed one; also, rather than a separate member such as the action tool 151 being provided, a site which can be hooked with a finger can be formed as the action unit on the outer peripheral surface of the front sleeve 112, with the site then being pulled forward in a direct manner.

(4) In the embodiment described above, the pressing part 111*a* and the pressed parts 131*a* corresponding thereto were formed in a tapered shape having an identical angle of incline, and the pressing part 111*b* and the pressed parts 131*b* corresponding thereto were formed in a tapered shape having an identical angle of incline. However, the shapes of the pressing parts 111*a*, 111*b* and the pressed parts 131*a*, 131*b* is not limited thereto. The description shall now relate to modification example for the shapes of the pressing part 111*a* and the pressed parts 131*a*, on the basis of FIGS. 8A to 8D in which the portions of the pressing part 111*a* and a pressed part 131*a* have been enlarged.

Figure 8A:
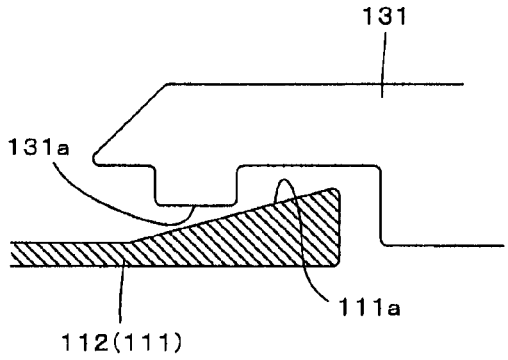
FIGS. 8A to 8D are cross-sectional views illustrating the shapes of a pressing part and a pressed part in other embodiments.
Figure 8B:
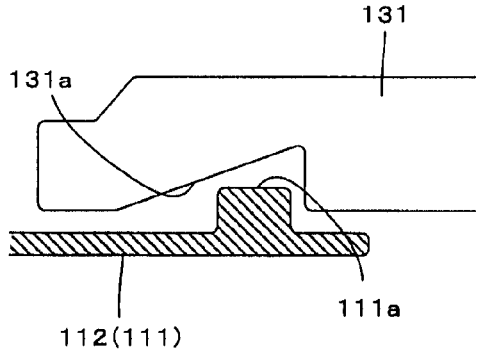

FIG. 8A is a drawing in which the pressing part 111*a* formed on the front sleeve 112 is given a tapered shape, and the pressed part 131*a* formed on a lug 131 is formed in a convex shape that projects radially inward. When then pressed part 131*a* is formed in the convex shape in this manner, too, the movement of the front sleeve 112 to the front side (the left side in the drawing) still makes it possible for the pressing part 111*a* to press the pressed part 131*a* radially outward and thus to push radially outward on the lug 131. Conversely, as is illustrated in FIG. 8B, it would also be possible for the pressed part 131*a* formed on the lug 131 to be given a tapered shape and for the pressing part 111*a* formed on the front sleeve 112 to be formed in a convex shape that projects radially outward.

Figure 8C:
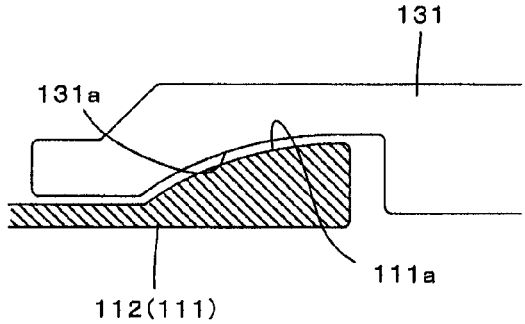
Figure 8D:
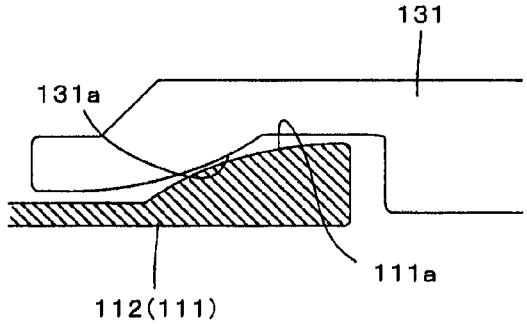

Also, as in FIGS. 8C and 8D, it would further be possible for the pressing part 111*a* formed on the front sleeve 112 and the pressed part 131*a* formed on the lug 131 to be constituted of curved surfaces. In FIG. 8C, both the pressing part 111*a* and the pressed part 131*a* are formed in tapered shapes by curved surfaces that spread radially outward from the front side toward the rear side and have the same curvature. Herein, the pressing part 111*a* has been formed into a convex-shaped curved surface that projects radially outward and, in accordance therewith, the pressed part 131*a* has been formed into a concave-shaped curved surface that sinks radially outward, but the pressing part 111*a* can also be formed into a concave-shaped curved surface that sinks radially outward and, in accordance therewith, the pressed part 131*a* can then be formed into a convex-shaped curved surface that projects radially outward. Furthermore, as is illustrated in FIG. 8D, it would also be possible for the pressing part 111*a* to be formed into a convex-shaped curved surface that projects radially outward and for the pressed part 131*a* to be formed into a convex-shaped curved surface that projects radially inward.

The foregoing modification examples of the shapes of the pressing part 111*a* and the pressed part 131*a* can also be applied to the pressing part 11*b* and the pressed part 131*b*. The modification examples of the pressing part 111*a* and the pressed part 131*a* illustrated herein are no more than examples, and a variety of other modification examples can also be adopted.

(5) A variety of modifications are also possible with respect to the configuration of each of the screw mechanisms provided to the core tube holding device 101. For example, in the embodiment described above, the forward and backward directions of the screws with respect to the direction of rotation are inverted at the two end parts of the connecting members 121, but the forward and backward directions of the screws with respect to the direction of rotation could also be identical. Also, a configuration can be adopted in which there is at least one of the two end parts of the connecting members 121 to which a screw is provided, and the other is fixed to the sleeves 111 by, for example, a set screw.

The core tube holding device as in the invention is not limited to the image recording device, and could also be applied to other devices or applications.

What is claimed is:

1. A core tube holding device for holding a cylindrical core tube extending in the axial direction, in a state where an inner peripheral surface of the core tube has been pressed out in a radially outward direction orthogonal to the axial direction, the core tube holding device comprising:

a plurality of out-pushing members that are arranged side by side spaced apart in the axial direction, each of the out-pushing members having a pressing part that faces radially outward;

a connecting member for connecting the plurality of out-pushing members;

a holding member that has a pressed part facing the pressing part in the axial direction at every position in the axial direction corresponding to the pressing parts, and that is disposed radially outward with respect to the plurality of out-pushing members; and an action unit adapted to exert a force for moving, to one side in the axial direction, a one end out-pushing member which, among the plurality of out-pushing members, is at an end on the one side;

wherein at least one from among the pressing parts and the pressed parts is formed in a tapered shape that spreads radially outward from the one side to the other side in the axial direction, and when the force for moving the one end out-pushing member acts thereon via the action unit, the one end out-pushing member moves to the one side while also pulling another out-pushing member among the plurality of out-pushing members via the connecting member, and the pressing parts of each of the out-pushing members push the holding member radially outward via the corresponding pressed parts.

2. The core tube holding device as set forth in claim 1, wherein a through hole perforating through in the axial direction is formed on the one end out-pushing member, and the action unit is provided with a grip part provided closer to the one side than the through hole;

a shaft part which extends out from the grip part to the other side, and is inserted into the through hole; and a collar part provided to the shaft part closer to the other side than the through hole, the diameter of the collar part being greater than that of the through hole.

3. The core tube holding device as set forth in claim 2, further comprising a support member for slidably supporting the plurality of out-pushing members, the support member being inserted into holes opening in the axial direction formed on the plurality of out-pushing members;

wherein:

in the one end out-pushing member, the hole is formed so as to enclose the collar part while also communicating with the through hole from the other side; and the shaft part is connected via a screw mechanism to an end part on the one end of the support member; and when the action unit is rotated with respect to the support member, the one end out-pushing member is thereby moved to the one side.

4. The core tube holding device as set forth in claim 1, wherein there are at least three of the holding members provided at equal spacing in the peripheral direction.

5. The core tube holding device as set forth in claim 1, wherein both the pressing parts and the pressed parts are formed in similar tapered shapes that spread radially outward from the one side toward the other side.

6. The core tube holding device as set forth in claim 1, further comprising a spring for urging the holding member radially inward.

7. An image recording device for recording an image onto a sheet of a recording medium, the image recording device comprising:

a core tube holding unit for holding a cylindrical core tube extending in the axial direction, in a state where an inner peripheral surface of the core tube has been pressed out in a radially outward direction orthogonal to the axial direction; and a rotating mechanism for supplying the recording medium from the core tube or for taking up the recording medium around the core tube by causing the core tube holding means to rotate, the rotating mechanism being connected to the core tube holding means;

wherein:

the core tube holding means is provided with:

a plurality of out-pushing members that are arranged side by side spaced apart in the axial direction, each of the out-pushing members having a pressing part that faces radially outward;

a connecting member for connecting the plurality of out-pushing members;

a holding member that has a pressed part facing the pressing part in the axial direction at every position in the axial direction corresponding to the pressing parts, and that is disposed radially outward with respect to the plurality of out-pushing members; and an action unit adapted to exert a force for moving, to one side in the axial direction, a one end out-pushing member which, among the plurality of out-pushing members, is at an end on the one side;

wherein:

at least one from among the pressing parts and the pressed parts is formed in a tapered shape that spreads radially outward from the one side to the other side in the axial direction, and when the force for moving the one end out-pushing member acts thereon via the action unit, the one end out-pushing member moves to the one side while also pulling another out-pushing member among the plurality of out-pushing members via the connecting members, and the pressing parts of each of the out-pushing members push the holding member radially outward via the corresponding pressed parts.

* * * * *